US005975598A

United States Patent [19]

Fischer

[11] Patent Number: 5,975,598

[45] Date of Patent: Nov. 2, 1999

[54] RESTRICTOR DEVICE

[75] Inventor: John Fischer, Wellington, New Zealand

[73] Assignee: Interlock Group Limited, New Zealand

[21] Appl. No.: 08/930,873

[22] PCT Filed: Apr. 10, 1996

[86] PCT No.: PCT/NZ96/00029

§ 371 Date: Oct. 7, 1997

§ 102(e) Date: Oct. 7, 1997

[87] PCT Pub. No.: WO96/31676

PCT Pub. Date: Oct. 10, 1996

[30] Foreign Application Priority Data

Apr. 5, 1995 [NZ] New Zealand ..... 270874

[51] Int. Cl.[6] ..... E05C 17/04

[52] U.S. Cl. ..... 292/338; 292/277

[58] Field of Search ..... 292/262, 265, 292/275, 277, 252, DIG. 19, 338, 339; 16/49

[56] References Cited

U.S. PATENT DOCUMENTS 984,594 2/1911 O'Rourke .
1,211,733 1/1917 McQueen .
1,822,719 9/1931 Wellman .
2,037,261 4/1936 Nenninger .
3,696,744 10/1972 Etchell ..... 101/415.1
3,917,331 11/1975 Duran ..... 292/338
5,653,486 8/1997 Stillwagon ..... 292/252
5,727,286 3/1998 Shen ..... 16/49

*Primary Examiner*—Steven Meyers
*Assistant Examiner*—Gary Estremsky
*Attorney, Agent, or Firm*—Blakely Sokoloff Taylor & Zafman

[57] ABSTRACT

A restrictor device for limiting the degree of opening of an openable closure. The restrictor device has an arm (10) with a mounting plate (12) to pivotally mount the arm to either the closure or the frame on which the closure is mounted. The arm (10) is furthermore coupled to the closure or the frame as the case may be by a slideable element (16) to which the arm is pivotally coupled by a pivot (15). A movement restricting device is incorporated in the slideable element (16) whereby the movement of the slideable element can be selectively restricted.

9 Claims, 2 Drawing Sheets

RESTRICTOR DEVICE

BACKGROUND OF THE INVENTION

This invention relates to a restrictor device for use in restricting the extent of opening of an openable closure and more particularly a window.

Restrictor devices for limiting the extent of opening of a window sash for security and safety purposes are known. Such restrictor devices can, for example, limit the opening of the sash so as to provide for ventilation but prevent unauthorised entry from the outside through the window. Such restrictor devices are also useable to provide safety so as to prevent a window sash opening to such an extent that, say, a small child could pass through the gap between the open sash and the window frame. Additionally a restrictor device can limit the extent of opening so as to prevent, in the event of uncontrolled opening, a person from being drawn through the window opening.

On exceptionally large window sashes restrictor devices can also provide additional control of the sash when friction stays are fitted. Furthermore, when the sash is simply hung on hinges the restrictor device provides the sole means of control of the extent of opening and in many cases maintenance of the sash in the open position.

Restrictor devices whether they be for security or safety purposes or simply to control the sash suffer from a number of drawbacks. For example, they are not versatile in operation in that they usually provide control only at specific degrees of openness of the sash. Furthermore they usually only provide control in one direction. Even further, some restrictor devices can become disengaged upon a force in the opening direction arising, eg due to a wind gust. Such disengagement will permit the sash to slam closed resulting in damage and/or physical danger to someone attending the window or can result in the security/safety purpose of the restrictor being lost.

SUMMARY OF THE INVENTION

The object of the present invention is to provide a restrictor device which overcomes or at least goes some way to overcoming the drawbacks associated with known restrictor devices and in particular provides for control at any angle of opening of the closure within a range of open angles.

Broadly in one aspect of the invention there is provided a restrictor device for limiting the degree of opening of an openable closure, the restrictor device comprising an arm adapted for pivotal mounting to either the closure or the frame in which the closure is mounted, said arm furthermore being coupled to the closure or the frame as the case may be, said coupling being effected by a slideable element pivotally coupled to the arm, there being included restricting means whereby the movement of the slideable element can be selectively restricted.

DETAILED DESCRIPTION OF PREFERRED EMBODIMENT OF THE INVENTION

Figure 1:
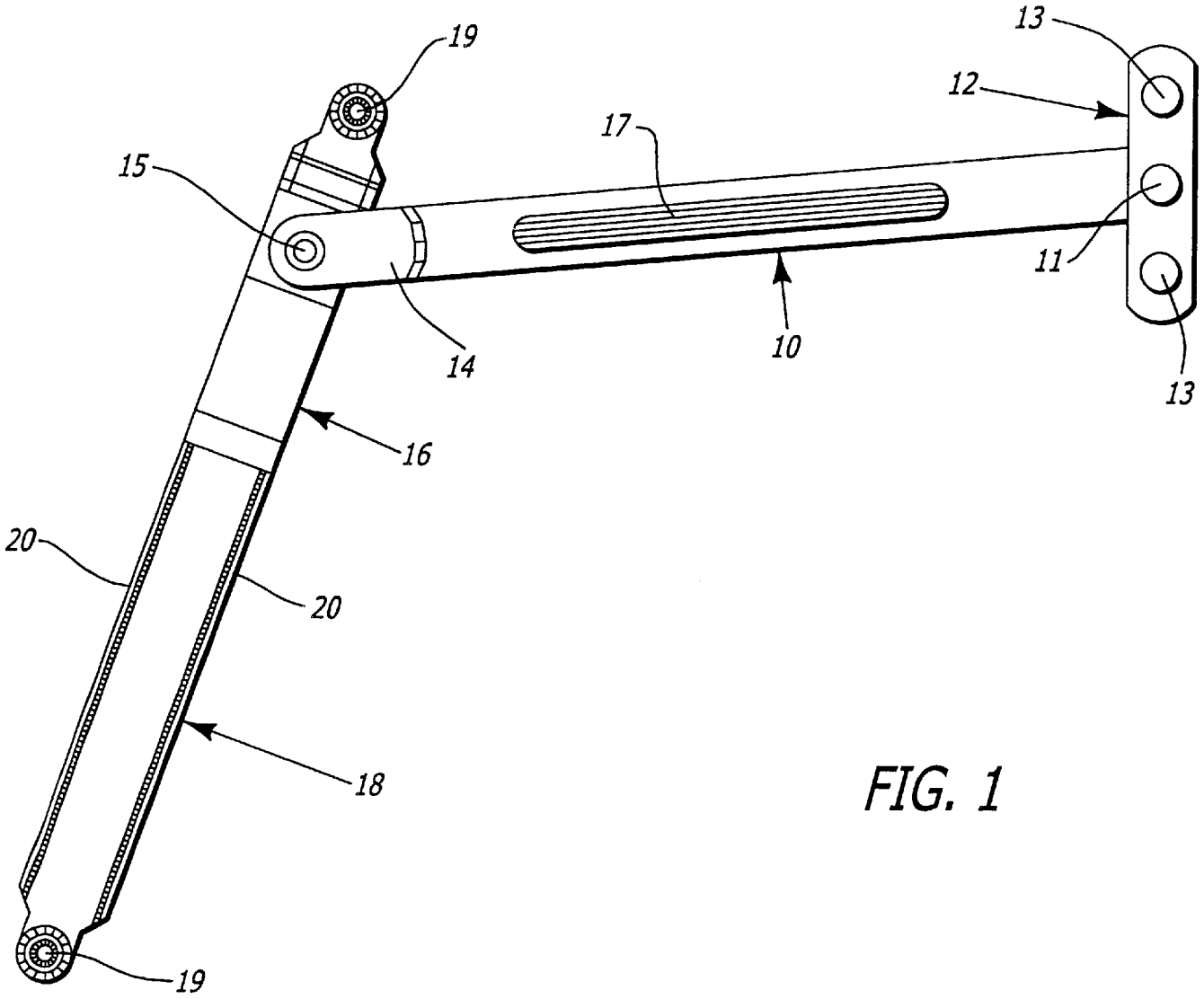
FIG 1 is an elevation view of the restrictor device according to one form of the invention.

As shown in FIG. 1 the restrictor device comprises an arm 10 which is pivotally coupled at one end via pivot 11 to a mounting plate 12. The mounting plate includes a pair of spaced apart openings 13 through which mechanical fasteners can engage so as to mount the mounting plate 11 to either the frame of a window or the window sash but preferably the frame.

The arm 10 is provided with a cranked end 14 which is engaged via a pivot 15 to a carriage 16. In the preferred form of the invention the arm 10 includes a longitudinally extending reinforcing rib 17.

Carriage 16 is slidingly engaged within a track 18. At each end of the track 18 there is provided an opening 19 through which mechanical fastenings can engage in order to fixedly mount the track 18 to the edge of the window sash. In the event that the mounting plate 11 is attached to the window sash the track is naturally mounted to an edge surface of the window frame.

In the illustrated form of the invention the track includes side walls 20 which are configured and cooperate with the carriage 16 such that the carriage is slidingly captured. As is apparent from FIG. 1 the carriage is free to move relative to the track along the longitudinal axis of both the track and the carriage.

Figure 2:
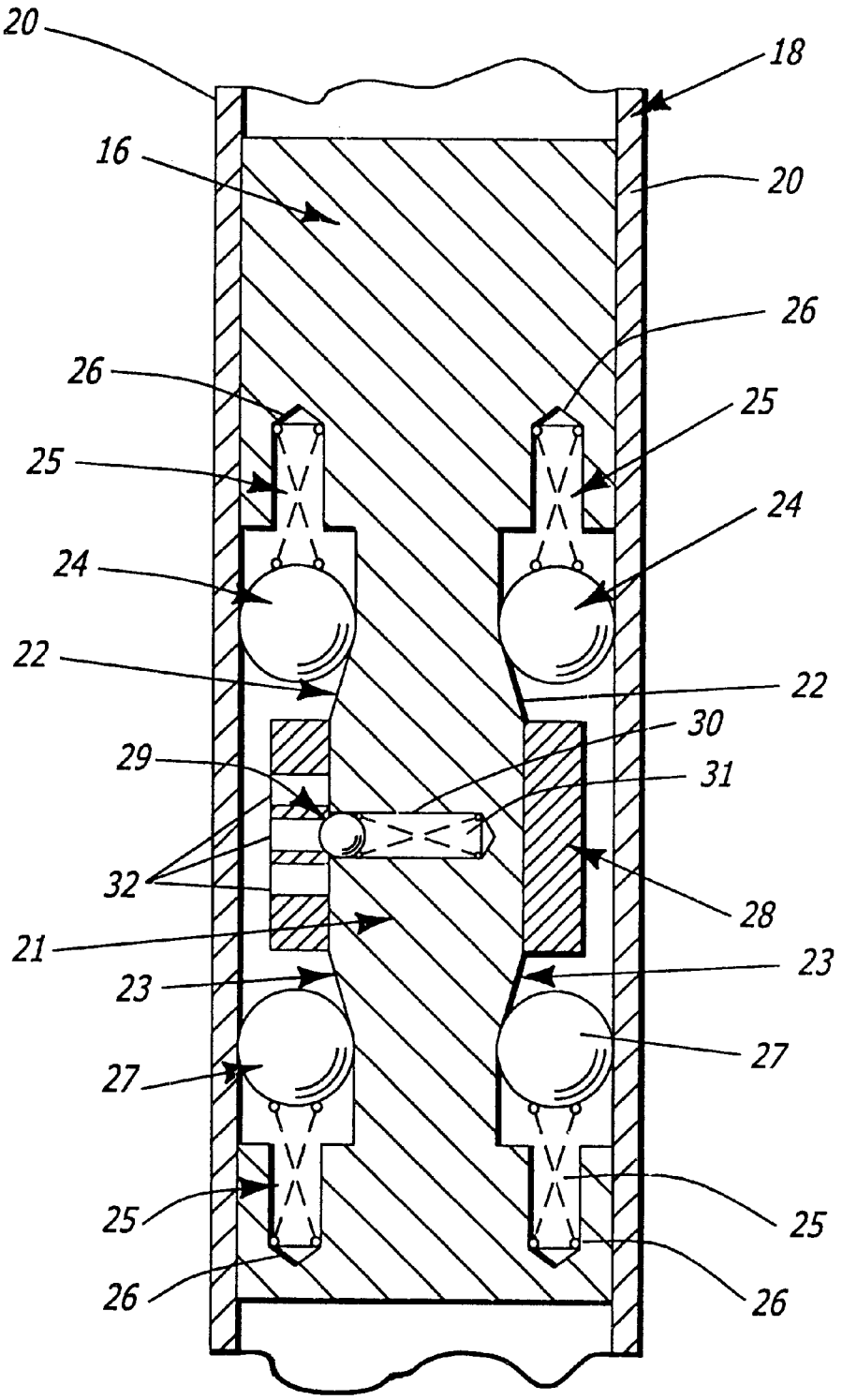
FIG. 2 is a cross-sectional view through the slideable element and the track in which the slideable element is engaged.

According to the present invention a mechanism is incorporated with the carriage such that the movement of the carriage relative to the track can be selectively restricted. This is more particularly illustrated in FIG. 2 of the accompanying drawings.

In the length of the carriage 16 there is formed a waisted portion 21 which includes two pairs of inclined surfaces 22 and 23, the surfaces of each pair converging toward the respective ends of the carriage 16. A roller or ball 24 is held against each of inclined surfaces 22 by springs 25 having one end thereof engaged in a suitable bore 26 in the body of the carriage 16. Likewise rollers or balls 27 are held against inclined surfaces 23.

When the carriage 16 is moved relative to track 18 the rollers become wedged between the carriage and the track preventing movement of the carriage 16 relative to the track 18.

A sliding switch 28 is fitted to the carriage and by movement of the switch as hereinafter described three modes of control can be achieved, these modes of control being:

1. Free to open—unable to close.
2. Unable to open—unable to close.
3. Unable to open—free to close.

Switch 28 has three positions in which it can be placed with each position being determined by a detent mechanism. In illustrated form the detent mechanism is a ball 29 biased by a spring 30 located in a bore 31 in the waisted portion 21 of the carriage 16. The ball 29 can selectively be engaged in any one of openings 32. In the illustrated arrangement in FIG. 2 the ball 29 is in the central opening 32 with the result that all four rollers 24 and 27 are held against their respective inclined surfaces or ramps 22 and 23 respectively. As a consequence the carriage 16 is locked in position relative to the track and is unable to move in either direction along the track.

When the switch is moved in either direction it displaces one pair of rollers 24 or 27 and holds them clear of their abutting inclined surfaces 22 and 23 respectively. The rollers then cannot become wedged between the carriage 16 and the side walls 20 of the track with the result that movement of the carriage relative to the track can occur in the direction that the switch 28 is moved. The carriage is, however, still prevented from moving in the opposite direction by the second pair of balls.

Consequently the selected position of switch 28 can result in the three modes of control referred to above, namely, the window may be free to open but unable to be closed or is locked in a position where it is unable to open or close or it can be closed but unable to be opened.

Provision can be made for remotely operating switch 28. This is particularly necessary when the sash reaches the closed position so as to enable the switch 28 to be moved such as to allow the sash to be opened. If the restrictor is contained within a closed cavity the switch will be inaccessible hence the need for remote control thereof. Alternatively, the switch can be automatically displaced as the sash nears the fully closed position by bearing against a suitably disposed fixed stop or some other appropriate actuator. In a simple remote control arrangement a lever can be coupled to the switch. By having the lever accessible when the sash is closed the switch can be slid to the position necessary to permit the carriage to slide along the track and hence allow the sash to open. The restrictor device according to the present invention thus can provide control at any angle of opening up to the maximum open angle and this is selectively achievable by manipulation of the switch 28. It is therefore believed that the restrictor according to the present invention overcomes the limitations and drawbacks associated with known restrictor devices used for limiting the opening of a window sash relative to a window frame or, for that matter, any openable closure mounted within a frame such as a hinged door.

I claim:

1. A restrictor device for limiting the degree of opening of an openable closure, the restrictor device comprising:

an arm;

means for pivotal mounting of the arm to either an openable closure or a frame on which the openable closure is mounted;

a slideable element wherein the arm is coupled to the slideable element;

an elongate mounting element on which the slideable element is slidingly moveable between a first and second positions;

an inclined wedging surface moveable with the slideable element;

an engagement surface fixed with the elongate mounting element and relative to which the inclined wedging surface is moveable;

a first wedging element moveable with the slideable element and located between the inclined wedging surface and the engagement surface;

means for biasing the first wedging element into wedging contact between the inclined wedging surface and the engagement surface to prevent movement of the slideable element toward the second position;

means for selecting a holding position to hold the first wedging element in a non-wedging position;

means for retaining the means for selecting in the holding position; and means for actuating the means for selecting to cause the means for selecting to release the first wedging element from the non-wedging position when the slideable element is substantially at the second position.

2. The restrictor device of claim 1 wherein the slideable element is a carriage and the engagement surface is a track.

3. The restrictor device of claim 2 wherein the elongate mounting element comprises a pair of side walls between which the carriage is slidingly captured, wherein the engagement surface is formed by at least part of one of the pair of side walls.

4. The restrictor device of claim 3 wherein the first wedging element is a complementary pair of wedging elements each of which is adapted to wedgingly engage between an inclined wedging surface and a side wall.

5. The restrictor device of claim 4 wherein the means for selecting is mounted with and movable relative to the slideable element.

6. The restrictor device of claim 5 wherein the means for retaining comprises a detent mechanism.

7. The restrictor device of claim 5 further comprising:

means for operating the means for selecting from a remote location wherein the means for retaining comprises a ball disposed within a bore formed in the carriage, wherein the ball is biased by a spring towards one of three detents formed within the means for selecting.

8. The restrictor device of claim 1 further including a second wedging element located between a further inclined wedging surface and a fixed engagement surface, wherein the second wedging element is maintainable in a non-wedging position when the slideable element is at the first position so that the carriage may be moved in a first direction and restricted from movement in a second direction.

9. The restrictor device of claim 8 further comprising:

a third position disposed between the first position and the second position wherein the carriage is restricted from moving in the first direction and in the second direction when the slideable element is at the third position.

* * * * *